US005758435A

United States Patent [19]

Miyata

[11] Patent Number: 5,758,435

[45] Date of Patent: Jun. 2, 1998

[54] TRAINING SHOES FOR APPLYING A LARGER-THAN-NORMAL LOAD

[75] Inventor: Yoshiaki Miyata, Osaka, Japan

[73] Assignee: Miyata Co., Ltd., Osaka, Japan

[21] Appl. No.: 685,103

[22] Filed: Jul. 22, 1996

[30] Foreign Application Priority Data

May 23, 1996 [JP] Japan ..... 8-127992

[51] Int. Cl.[6] ..... A13B 5/00; A13B 13/00

[52] U.S. Cl. ..... 36/132; 36/25 R

[58] Field of Search ..... 36/132, 59 R, 36/25 R, 113, 136, 107, 103

[56] References Cited

U.S. PATENT DOCUMENTS

| | | | |
|---|---|---|---|
| 3,517,928 | 6/1970 | Shanahan | 36/132 X |
| 3,573,155 | 3/1971 | Mitchell | 36/59 R X |
| 3,785,646 | 1/1974 | Ruskin | 36/132 X |
| 4,686,781 | 8/1987 | Bury | 36/132 |
| 4,709,921 | 12/1987 | Valuikas et al. | 36/132 X |
| 5,231,776 | 8/1993 | Wagner | 36/132 X |

FOREIGN PATENT DOCUMENTS

| | | | |
|---|---|---|---|
| 2572257 | 5/1986 | France | 36/132 |
| 2950043 | 7/1981 | Germany | 36/132 |
| 1166710 | 7/1986 | Japan | 36/59 R |

*Primary Examiner*—B. Dayoan

*Attorney, Agent, or Firm*—Wenderoth, Lind & Ponack

[57] ABSTRACT

A training shoe can apply a larger-than-normal load to leg muscles to strengthen them while maintaining good flexibility, cushioning properties and other necessary properties required for shoes. Regularly arranged weight chambers are formed in a resilient outsole. Weights formed of a mixture of metallic grains and an adhesive are embedded in the weight chambers. A rubber layer is provided between the outsole and a middle sole, and a thick cup-shaped insole is laid on the middle sole to absorb shocks. Also, a fairly thick tongue is provided to protect the instep of a foot.

5 Claims, 5 Drawing Sheets

TRAINING SHOES FOR APPLYING A LARGER-THAN-NORMAL LOAD

BACKGROUND OF THE INVENTION

This invention relates to a training shoe which can apply a larger-than-normal load to leg muscles and strengthen them while the wearer of the shoe is walking or otherwise exercising.

Conventional training shoes of this type include ones having a weight such as an iron plate or rod or a lead member embedded in the sole to increase the overall weight of the shoe. During exercise, a larger load is applied to leg muscles, especially thigh muscles, of the wearer of such shoes than when he or she exercises in ordinary athletic shoes, so that these muscles strengthen.

Another type of shoes having an embedded metal plate are so-called safety shoes. They have an iron plate embedded in their toe tips and are worn by factory workers and construction workers to protect their toes against any heavy falling object. Since such safety shoes have to be made sturdy enough, they have a rather hard and thick sole.

Such conventional training shoes have a problem in that the metal member embedded in the sole as a weight excessively reduces flexibility of the sole, making it extremely difficult for the wearer of such shoe to flex his or her ankle joints. Thus they lack required functions as training shoes. Also, due consideration was not given for shock absorbability. Thus the shoes may cause foot injury.

Safety shoes are intended solely to protect toes against heavy objects. No consideration is given to flexibility and shock absorbability and other basic functions required for ordinary shoes. Since a heavy metal plate is provided only at the toes, the weight difference is large between the toe and the heel. That is, the weight balance was not good. Such shoes are not suitable as athletic shoes.

As mentioned above, conventional training shoes lack many of the basic requirements of training shoes.

An object of the present invention is to provide a training shoe which can apply a larger-than-normal load to leg muscles to strengthen them while maintaining good flexibility and cushioning properties.

SUMMARY OF THE INVENTION

According to the present invention, there is provided a training shoe having a sole formed with a plurality of air gaps in which are embedded metallic grains. There is also provided a training shoe having a resilient sole formed with weight chambers arranged in a regular pattern, the weight chambers having a mixture of metallic grains and an adhesive embedded therein. Also, there is provided a training shoe having a sole made of a resilient material in which are mixed metallic pieces.

Since the metallic grains or metallic pieces as weights are distributed uniformly over the entire area of the sole without impairing the resilience of the sole, the weight balance of the shoe is good. The weights increase the weight of the shoe. It is thus possible to strengthen leg muscles of the wearer by applying a large load to the leg muscles.

Any of the shoes according to the present invention may further comprise a shock absorbing means for absorbing shocks applied thereto and a protective means for protecting an instep of a foot. These means lighten shocks applied to the wearer's legs and shocks and compression inflicted on the insteps of the wearer's feet. In short, they can protect the foot insteps and prevent leg injuries.

Other features and objects of the present invention will become apparent from the following description made with reference to the accompanying drawings, in which:

DETAILED DESCRIPTION OF THE PREFERRED EMBODIMENT

Figure 1:
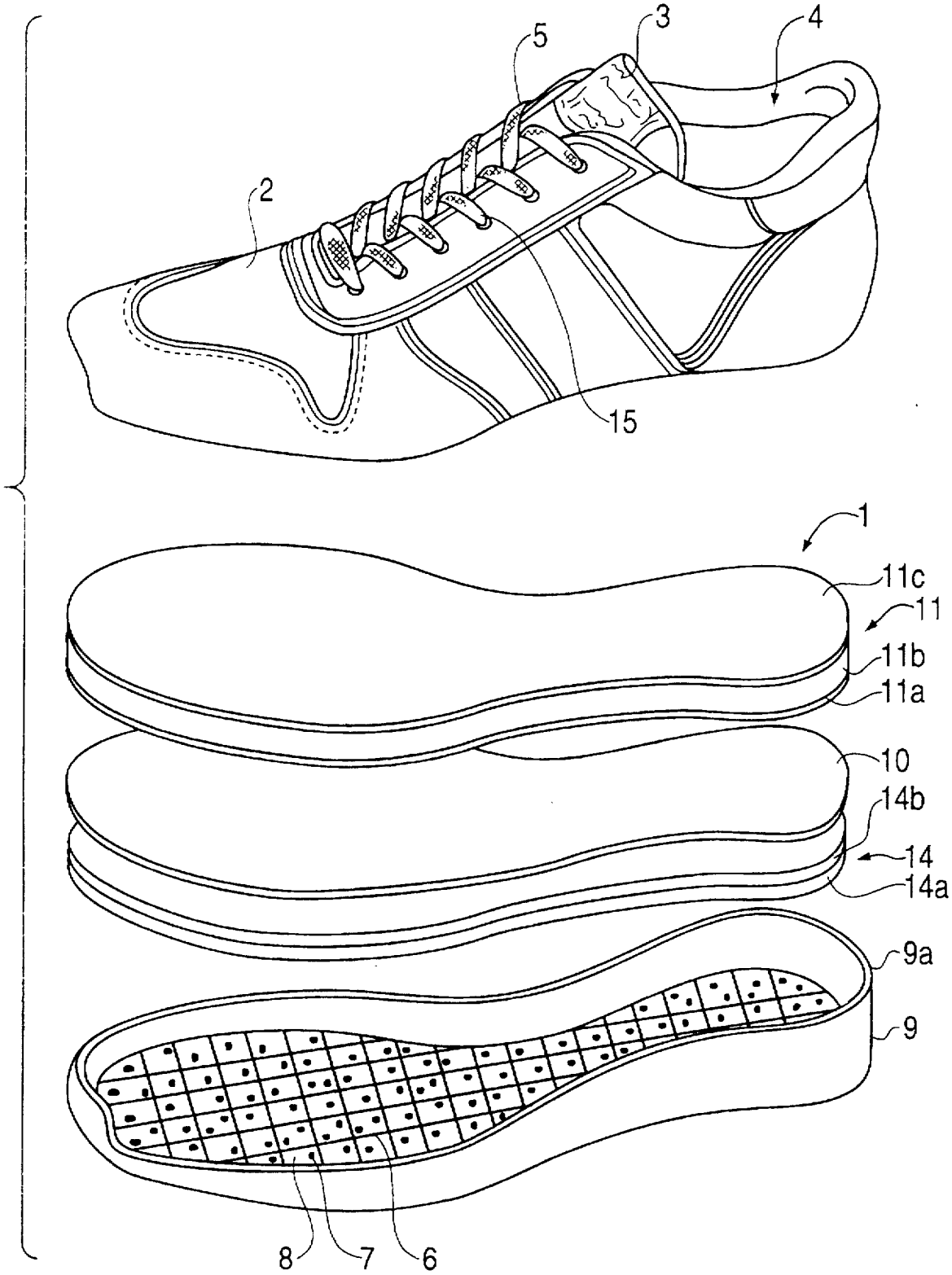
FIG. 1 is an exploded perspective view of a training shoe embodying the present invention.

Referring to FIG. 1, the training shoe according to the present invention comprises a sole 1 to be brought into contact with the sole of a foot, uppers 2 covering the instep of the foot, a tongue 3 to be brought into contact with the instep of the foot, and a lace 5 for adjusting the degree of opening of the shoe mouth 4. The sole 1, made of a resilient material, is partitioned into a plurality of weight chambers 6 in which are received weights 8 containing metallic grains 7. The shoe is also provided with a shock absorbing means for absorbing shocks that may be otherwise inflicted on the foot, and a protective means for protecting the insole of the foot.

Figure 2:
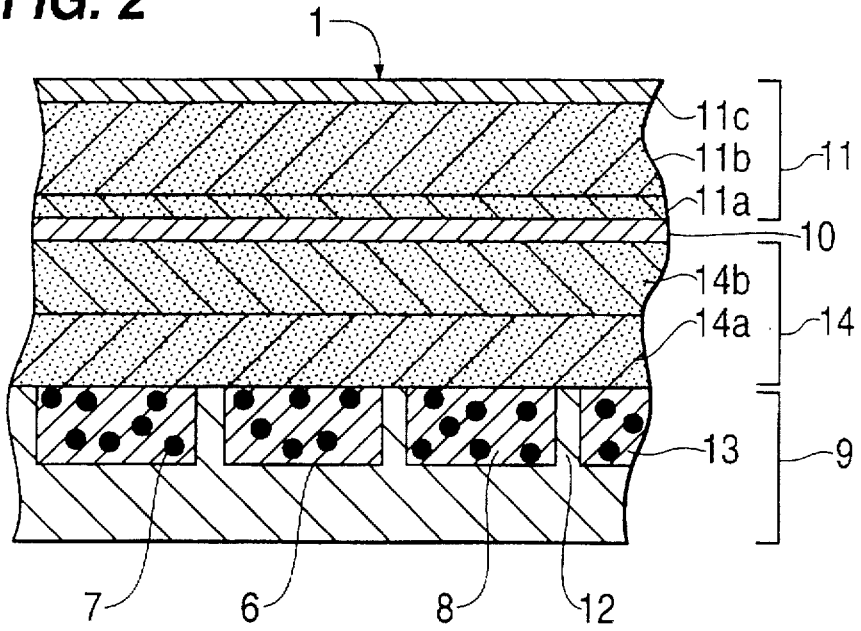
FIG. 2 is a sectional view of its sole.
Figure 3:
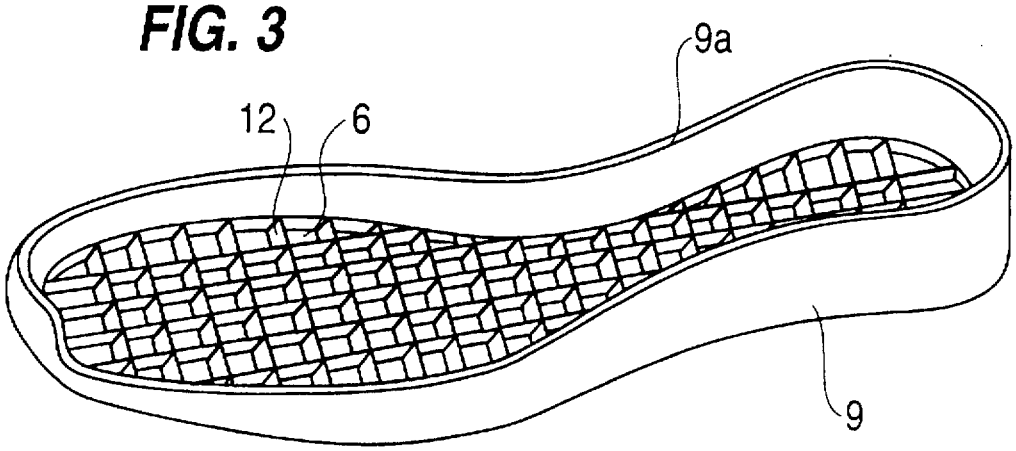
FIG. 3 is a perspective view of the outsole.

As shown in FIG. 2, the sole 1 comprises an outsole 9, a middle sole 10 and an uppermost cup-shaped insole 11 superposed one on another. The outsole 9 is an ordinary one used in conventional training shoes. It is made of a resilient material which is a mixture of natural rubber and a synthetic rubber and has a rising peripheral edge 9*a*.

Figure 4A:
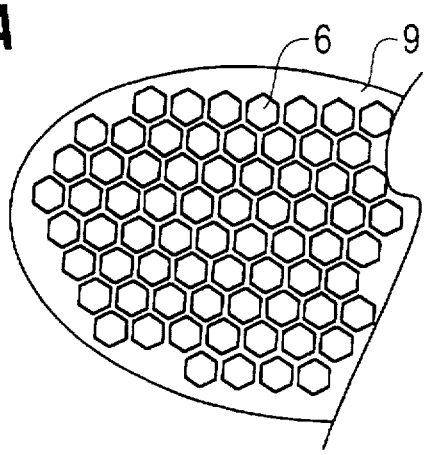
FIGS. 4A, 4B and 4C are views of honeycomb, circular and triangular weight chambers, respectively.
Figure 4B:
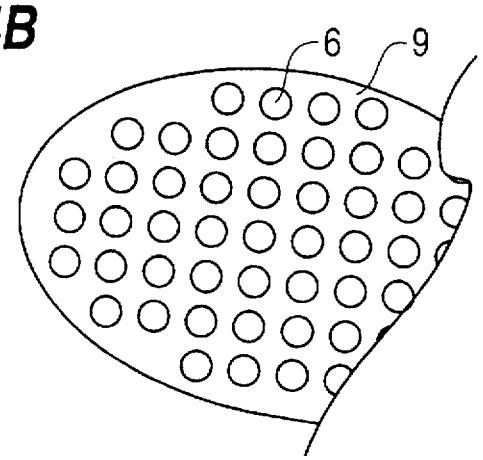
Figure 4C:
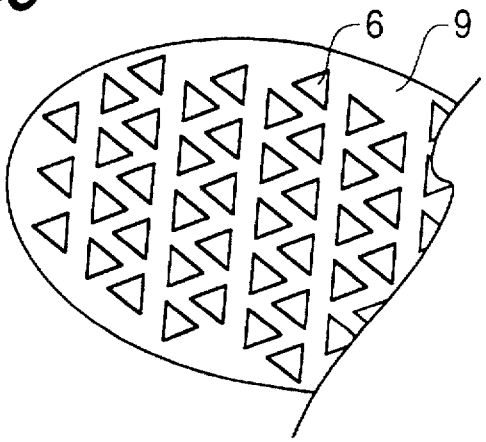

The weight chambers 6 are recesses partitioned by vertical walls 12 arranged regularly in a lattice pattern. The bottom of the chambers 6 are 3 mm or higher from the bottom surface of the outsole 9. A weight 8 is buried in each chamber 6. The weight chambers 6 may be integrally formed when molding the outsole 9 with a molding machine, or formed with a die after the outsole 9 has been molded. As shown in FIGS. 4A, 4B and 4C, the chambers 6 may be honeycomb, circular or triangular recesses.

The weights 8 comprise a mixture of an adhesive matrix 13 and metallic grains 7 buried in the matrix 13. The metallic grains 7 are lead balls about 1 mm in diameter. The adhesive matrix 13 is a rubber adhesive adapted to set by drying. The metallic grains 17 are mixed in the adhesive matrix 13 at the ratio of 9:1 and dispersed uniformly in the adhesive matrix 13.

By changing the mixing ratio, it is possible to adjust the entire weight of the shoe within a range of 800–2000 grams, which is considerably large compared with the weight of an ordinary training shoe, which typically weighs 250–300 grams. By varying the weight of the shoe according to the gender and the build of the wearer, it is possible to adjust the load exerted on the leg muscles.

The weights 8 are buried snugly and uniformly in the weight chambers 6 and dried until the adhesive 13 sets and the metallic grains 7 are fixed with the top surface of the weight layer flat. In this state, the metallic grains 7 are distributed uniformly and unmovably over the entire area of the outsole 9. The metallic grains 7 may be non-lead metal balls such as iron or copper balls, metallic powder, or non-ball grains small enough to be received in the chambers 6. The metallic grains are preferably made of a metal having a large specific gravity so that the weight of the shoe can be increased efficiently. It is preferable to use an adhesive with a sufficiently high resilience so that the outsole 9 can maintain high flexibility while keeping high resilience.

The cup-shaped insole 11 has a three-ply structure having a total thickness of 6 mm and comprising an EVA (ethylene-vinyl acetate copolymer) sponge layer 11*a*, a foamed latex layer 11*b* and a polyester substrate 11*c* laminated in this order from below and bonded together with an adhesive. A cup-shaped insole used in an ordinary athletic shoe with no added weights is less than 5 mm thick.

A rubber layer 14 is disposed between the outsole 9 and the middle sole 10. The rubber layer 14 comprises two three-mm-thick EVA sponge layers 14*a* and 14*b*. The shock absorbing means is made up of the cup-shaped insole 11 and the rubber layer 14. It functions as a shock absorber.

The thicknesses of the cup-shaped insole 11 and the rubber layer 14 are not limited to those shown in the embodiment but may be greater or smaller as long as they can sufficiently absorb shocks. The thickness of the cup-shaped insole 11 may be even as thin as an ordinary cup-shaped insole. The shock absorbing means may consist of such an insole 11 and the rubber layer 14. The rubber layer 14 may consist of a single 6-mm-thick EVA sponge layer. Also, it may be made of a cushioning material other than EVA sponge.

Figure 5:
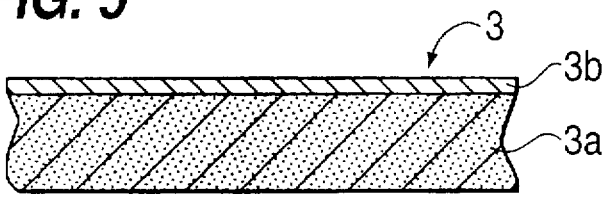
FIG. 5 is a sectional view of the tongue.

The tongue 3 has a thickness 1.5 times the thickness of a conventional tongue, which is typically about 15 mm thick. As shown in FIG. 5, it comprises a 33-mm-thick urethane foam layer 3*a* and a 0.6-mm-thick urethane synthetic leather 3*b* layer laminated together. This sufficiently thick tongue 3 constitutes the protective means for protecting the instep of the foot. As long as it can protect the instep of the foot, its thickness is not limited to the above value.

The uppers 2 are made of synthetic fiber or synthetic leather and have a mouth 4 through which a foot is inserted and eyelets 15 through which the shoe lace 5 is passed. By tightening the shoe lace 5, the degree of opening of the mouth 4 is adjustable. Preferably, the uppers 2 are formed so that when the foot is inserted in the shoe, the mouth 4 is located above the ankle of the wearer so as to cover the ankle with the uppers 2. With this arrangement, it is possible to lighten a load that acts on the ankle, protect it and prevent the shoe from coming off during exercise.

Figure 6:
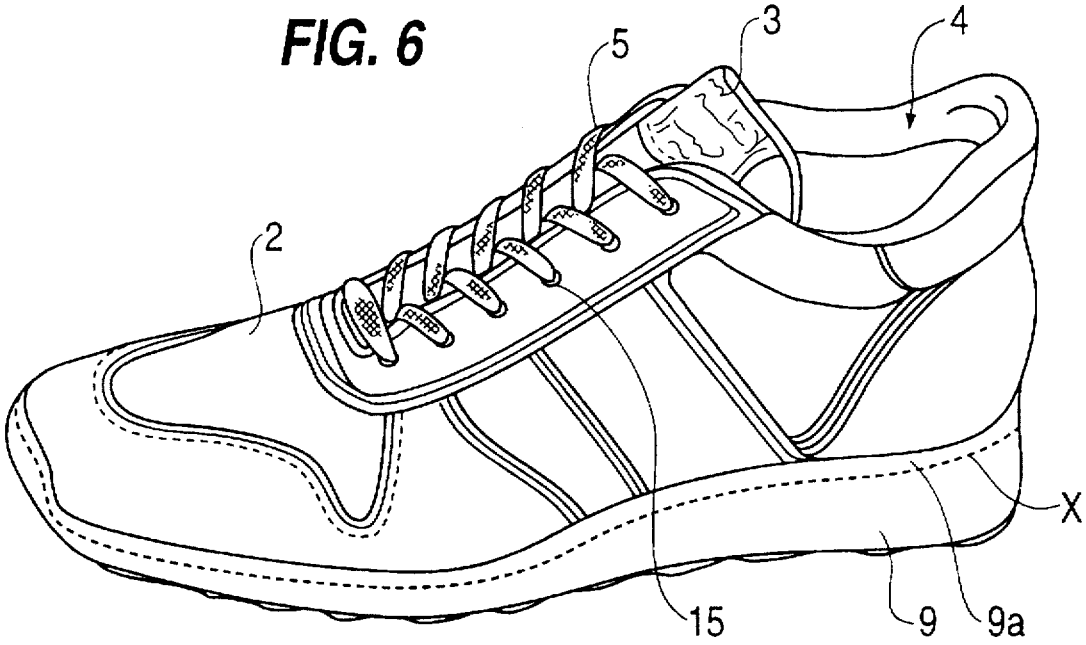
FIG. 6 is an outer perspective view of the training shoe.

The uppers 2 have their bottom cemented to the outsole 9. The rubber layer 14 and the middle sole 10 are laminated on the outsole 9 and bonded together. Further, as shown in FIG. 6 at line X, the uppers 2 have their bottom stitched to the peripheral edge 9*a* of the outsole 9 by the OPANKE process (a kind of shoe making process). Since the uppers are fixed to the outsole not only by bonding but by the OPANKE process, the cement-bonded portions between the uppers and the outsole will never peel even though the outsole 9 is unusually heavy due to the weights 8. The cup-shaped insole 11 is lastly inserted into the shoe through the mouth 4.

The shoe of this embodiment weighs 450 grams with no weights and 1400 grams with the weights.

When a person walks in the shoes according to the invention, a load which is larger by the weight of the weights than when walking in ordinary training shoes will act on muscles that work when legs are raised (mainly thigh muscles). Since the load acts repeatedly on these muscles, they are trained and strengthened. Every time the legs are raised, the entire weights of the shoes bear on the instep of each foot. But the tongue 3, softly covering the instep of each foot, will prevent load concentration, thus minimizing shocks and compression on the instep of each foot. It is thus possible to prevent foot injuries.

When a foot lands on the ground, the sole 1 will collide with the ground more violently because it is heavier than a sole of an ordinary training shoe. But the shocks due to collision with the ground will be absorbed, for the most part, by the rubber layer 14 of the sole 1 and the cup-shaped insole 11, so that shocks are scarcely transmitted to the legs. It is thus possible to prevent injuries to the legs.

When a foot is bent, the outsole 9 bends softly due to the resilience of the partitioning walls 12 covering the weights 8 in the weight chambers 6 of the outsole 9. Thus, the wearer can walk and run because the outsole bends smoothly.

The metallic grains 7 embedded in the chambers 6 in the resilient outsole 9 increase the weight of the entire shoe. Thus, simply by walking in the training shoes according to the invention, a large load will act on and strengthen leg muscles. Also, the load that acts on the ankle muscles will burn fat therearound, thus tightening the ankles, thighs and calves. In short, one can shape up his or her body. Simply by walking to school or office in the training shoes according to the invention, one can strengthen leg muscles or shape up.

The shock absorbing rubber layer 14 and the sufficiently thick cup-shaped insole 11 absorb shocks, so that shocks are scarcely transmitted to the legs. It is thus possible to prevent injuries to legs. The thick tongue 3 will minimize shocks and compression on the instep of each foot. It is thus possible to prevent injuries to insteps.

The metallic grains 7 mixed in the adhesive matrix 13 are embedded in the weight chambers 6 in a regularly arranged manner. That is, the metallic grains 7 are distributed uniformly over the entire area of the outsole 9. The shoe as a whole is thus uniform in weight distribution. It is highly flexible, too. Thus, it is suitable for use in any kind of exercise.

Since the weights 8 having the metallic grains 7 are invisible from outside, the shoe according to the invention is nothing different in its outer appearance from ordinary training shoes, so that one can go to school or office in the shoes according to the invention. It is possible to increase the weight of the shoe without impairing its inherent functions.

Figure 7:
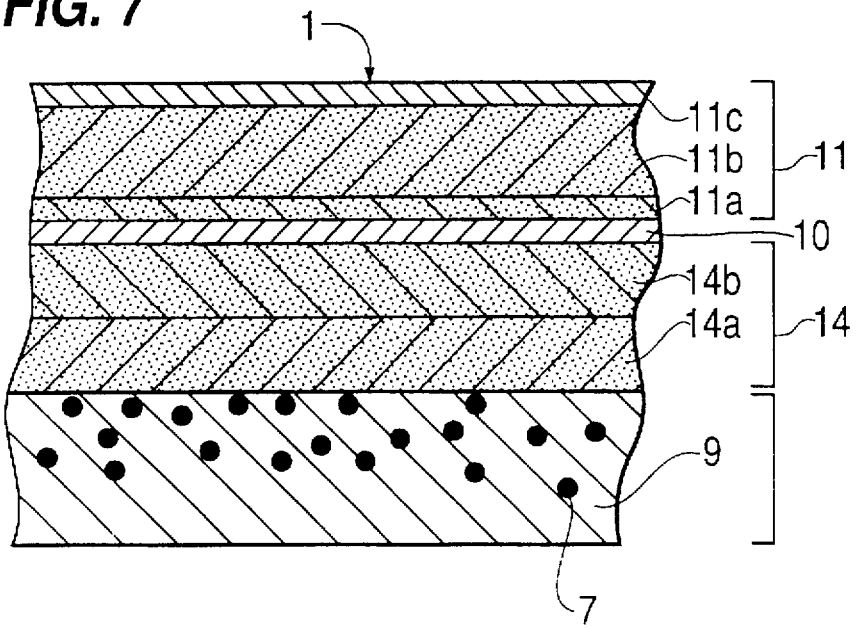
FIG. 7 is a sectional view of another embodiment.

FIG. 7 shows a training shoe in another embodiment. The outsole 9 of the sole 1 is made by molding natural or synthetic rubber with metallic grains 7 embedded therein. Otherwise, the metallic grains 7 may be pushed into the outsole 9 before it hardens.

The shoe of this embodiment will achieve the same effects as in the first embodiment. Further, the shoe of this embodiment is easier to manufacture. The metallic grains 7 may be mixed or buried not in the outsole 9 but in the rubber layer 14, middle sole 10 or cup-shaped insole 11.

The present invention is not limited to the above-described specific embodiments but is subject to various changes and modifications. For example, the weight chambers 6 may be formed in the cup-shaped insole 11 to embed the weights 8 therein. In this arrangement, since the cup-shaped insole 11 is detachable, the weights 8 are freely detachable from the shoe if it is desired to use the shoe as an ordinary light-weight training shoe. The weights 8 may also be embedded in weight chambers 6 formed in the rubber layer 14.

The weights 8 may be an amalgam paste of mercury and tin. Also, they may be metallic powder such as iron or lead powder filled in the spaces or kneaded in the material of the outsole 9.

There is a conventional training shoe having spaces formed in the sole to reduce weight. By filling such spaces with a mixture of metallic grains and adhesive, this conventional shoe becomes the shoe according to the present invention. Such a shoe can be manufactured easily from a conventional shoe at a low cost. The training shoe may have the shape of a business shoe instead of an ordinary sneaker.

Figure 8:
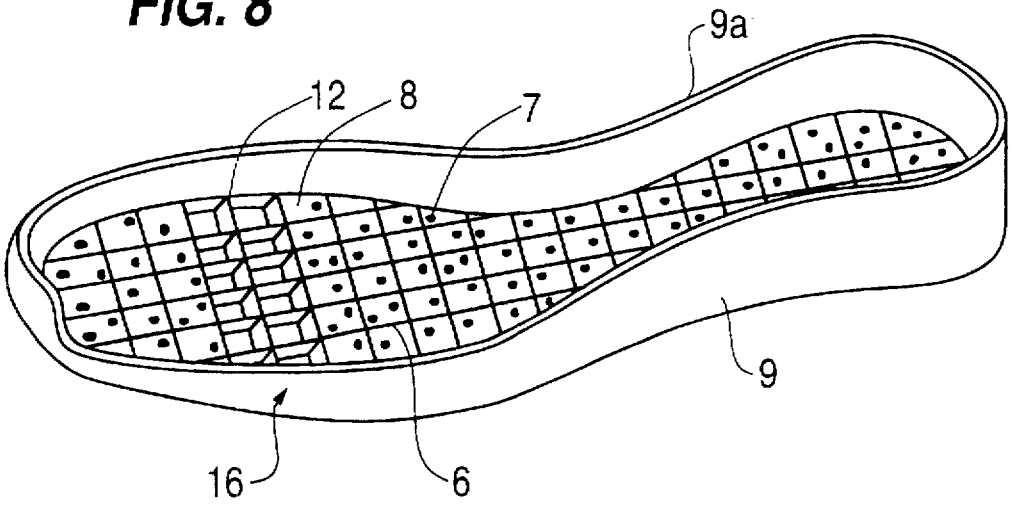
FIG. 8 is a perspective view of another embodiment in which weights are embedded in the outsole.

As shown in FIG. 8, in order to improve flexibility of the shoe, weights 8 may be omitted at a portion 16 of the outsole 9 corresponding to the toe joints of the foot to make the shoe easy to bend when the toe joints are bent.

According to the present invention, the weights in the form of metallic grains embedded in gaps formed in the resilient sole or metal mixed in the material of the sole increase the overall weight of the shoe. Thus, simply by walking in such shoes, a large load will act on the wearer's leg muscle, which makes it possible to strengthen leg muscles and shape up legs. The weights, fixed to the sole, will never impair the inherent resilience of the sole, so that the sole is bent smoothly when the wearer walks or runs.

In an arrangement in which a mixture of metallic grains and adhesive is embedded in regularly arranged weight chambers, the metallic grains are distributed uniformly, so that it is possible to improve the weight balance of the shoe while maintaining good flexibility. It is also possible to prevent uneven wear of the sole. The shock absorbing means for absorbing shocks applied thereto improves cushioning properties of the shoe. It is thus possible to soften shocks applied to legs. The protective means for protecting an instep of a foot inserted in the shoe protects the instep of the foot by softening shocks and compression that act on the instep of the foot. Thus, they prevent leg injuries.

The training shoe according to the present invention makes it possible to apply a larger-than-normal load on leg muscles while maintaining all the functions required for ordinary shoes. The wearer can thus unconsciously strengthen leg muscles.

What is claimed is:

1. A training shoe comprising:

a resilient sole formed with a plurality of weight chambers arranged in a regular pattern;

a plurality of weights mounted in said weight chambers, respectively; and wherein each of said plurality of weights comprises a mixture of an adhesive matrix and metallic grains dispersed and buried in said adhesive matrix.

2. A training shoe as recited in claim 1, wherein said metallic grains are uniformly dispersed in said adhesive matrix.

3. A training shoe as recited in claim 1, wherein said weight chambers respectively comprise recesses partitioned by vertical walls arranged regularly in a lattice pattern.

4. A training shoe as recited in claim 3, wherein each of said weights fills the recess constituting its respective weight chamber, such that upper surfaces of said weights are level with upper edges of said vertical walls.

5. A training shoe as recited in claim 1, wherein said weights are mounted unmovably in said weight chambers, respectively.

* * * * *